US009615435B2

(12) United States Patent
Engelen et al.

(10) Patent No.: US 9,615,435 B2
(45) Date of Patent: Apr. 4, 2017

(54) DEVICE FOR LINKING SELECTIVE ILLUMINATION OF A LIGHT SOURCE WITH INPUT AND RELATED METHODS

(71) Applicant: PHILIPS LIGHTING HOLDING B.V., Eindhoven (NL)

(72) Inventors: Dirk Valentinus René Engelen, Heusden-Zolder (BE); Tatiana Aleksandrovna Lashina, Eindhoven (NL); Dzmitry Viktorovich Aliakseyeu, Eindhoven (NL)

(73) Assignee: PHILIPS LIGHTING HOLDING B.V., Eindhoven (NL)

( * ) Notice: Subject to any disclaimer, the term of this patent is extended or adjusted under 35 U.S.C. 154(b) by 0 days.

(21) Appl. No.: 15/027,041

(22) PCT Filed: Sep. 23, 2014

(86) PCT No.: PCT/IB2014/064747

§ 371 (c)(1),
(2) Date: Apr. 4, 2016

(87) PCT Pub. No.: WO2015/049617

PCT Pub. Date: Apr. 9, 2015

(65) Prior Publication Data

US 2016/0242263 A1 Aug. 18, 2016

Related U.S. Application Data

(60) Provisional application No. 61/886,154, filed on Oct. 3, 2013.

(51) Int. Cl.
*H05B 37/04* (2006.01)
*H05B 37/02* (2006.01)

(52) U.S. Cl.
CPC ..... *H05B 37/0272* (2013.01); *H05B 37/0227* (2013.01); *H05B 37/0245* (2013.01)

(58) Field of Classification Search
CPC ..... H05B 33/0857; H05B 33/0863; H05B 37/029; H05B 33/0803; H05B 33/0818;
(Continued)

(56) References Cited

U.S. PATENT DOCUMENTS 6,016,038 A 1/2000 Mueller et al.
6,211,626 B1 4/2001 Lys et al.
(Continued)

FOREIGN PATENT DOCUMENTS

EP 1480497 A2 11/2004
WO 2009012048 A2 1/2009
(Continued)

OTHER PUBLICATIONS

Kuando, Busylight UC for Microsoft Lync, www.busylight.com, Jan. 2013 (1 Page).
(Continued)

*Primary Examiner* — Monica C King
(74) *Attorney, Agent, or Firm* — Meenakshy Chakravorty

(57) ABSTRACT

Systems, methods, apparatus and computer-readable media (transitory and non-transitory) are described herein for facilitating linking of selective illumination of one or more light sources (106, also referred to as "lighting elements") to states of one or more inputs (102). In various embodiments a linking computing device (104) may render, e.g., on a display (212) such as an ambient display, a source graphical element (214) that represents an input and a sink graphical element (216) that represents a light source. In various embodiments, the computing device may receive a user-input instruction to alter one of the source and sink graphical elements to be within a predetermined proximity of the other on the display. In various embodiments, the computing device may link selective illumination of the light source to
(Continued)

a state of the input while the source and sink graphical elements are within the predetermined proximity of each other on the display.

20 Claims, 4 Drawing Sheets

(58) Field of Classification Search
CPC H05B 33/0827; H05B 37/02; H05B 37/0254; H05B 33/0869; H05B 33/0872; H05B 37/0245; H05B 37/0272; F21V 33/004
See application file for complete search history.

(56) References Cited

U.S. PATENT DOCUMENTS

| | | | |
|---|---|---|---|
| 7,014,336 | B1 | 3/2006 | Ducharme et al. |
| 2003/0142204 | A1 | 7/2003 | Rus et al. |
| 2012/0034934 | A1 | 2/2012 | Loveland et al. |
| 2012/0212572 | A1 | 8/2012 | Yang |
| 2012/0242251 | A1 | 9/2012 | Kwisthout et al. |

FOREIGN PATENT DOCUMENTS

| | | | |
|---|---|---|---|
| WO | 2012090154 | A2 | 7/2012 |
| WO | 2013121311 | A1 | 8/2013 |

OTHER PUBLICATIONS

Codeplex Project Hosting for Open Source Software, http://yaam.codeplex.com, Last Edited Mar. 2011 (1 Page).
Microsoft Lync 2010 Basics, Cites Training Services, University of Illinois 2013 (30 Pages).
https://greiginsydney.com/lync-led-shootout, Review: Lync LED Shootout, Jan. 2013 (5 Pages).

DEVICE FOR LINKING SELECTIVE ILLUMINATION OF A LIGHT SOURCE WITH INPUT AND RELATED METHODS

CROSS-REFERENCE TO PRIOR APPLICATIONS

This application is the U.S. National Phase application under 35 U.S.C. §371 of International Application No. PCT/IB2014/064747, filed on Sep. 23, 2014, which claims the benefit of U.S. Provisional Patent Application No. 61/886,154, filed on Oct. 3, 2013. These applications are hereby incorporated by reference herein.

TECHNICAL FIELD

The present invention is directed generally to lighting control. More particularly, various inventive techniques disclosed herein relate to linking selective illumination of a light source with a state of an input.

BACKGROUND

Digital lighting technologies, i.e. illumination based on semiconductor light sources, such as light-emitting diodes (LEDs), offer a viable alternative to traditional fluorescent, HID, and incandescent lamps. Functional advantages and benefits of LEDs include high energy conversion and optical efficiency, durability, lower operating costs, and many others. Recent advances in LED technology have provided efficient and robust full-spectrum lighting sources that enable a variety of lighting effects in many applications. Some of the fixtures embodying these sources feature a lighting unit, including one or more LEDs capable of producing different colors, e.g. red, green, and blue, as well as a processor for independently controlling the output of the LEDs in order to generate a variety of colors and color-changing lighting effects, for example, as discussed in detail in U.S. Pat. Nos. 6,016,038, 6,211,626, and 7,014,336, incorporated herein by reference.

Various light sources may be selectively illuminated based on various input. For example, WIFI-connected HUE LED-based light bulbs, available from Koninklijke Philips Electronics are configured to enable users to create their personal lighting environment wirelessly. For instance, a lamp at a users' home may be logically connected to a remote lamp at their friend's home. After coming home, the user may switch on her connect lamp to cause an "I'm home" message to be sent to the remote lamp in the friend's home. The remote lamp may then illuminate in a manner that notifies the friend that the user has arrived home. As another example, a lamp may be positioned near a user's workspace and linked to her schedule, telephone activity and/or computer activity. Depending on the status of the user—e.g., whether the user is busy, on the phone, and so forth—the lamp may display various colors so that coworkers know whether it is OK to disturb the user. As yet another example, pictures or video may be used to drive selective illumination of a light source. For example, selective illumination of a light source may be driven by to a portion of a digital image or digitally renderable area, and the light source may be illuminated to emit the colors of that portion.

With each of these technologies, a different technique is used to connect an input to a light source. A user wishing to use more than one of these solutions may be faced with a plethora of individual methods of linking an input to a light source that, while perhaps user-friendly on an individual basis, collectively may be cumbersome for the user to manage. Similarly, the user may wish to have manual control of the light sources, without having to separately disconnect each individual light source from its corresponding input.

Thus, there is a need in the art for systems, methods, devices, apparatus and computer-readable media (transitory and non-transitory) to provide easy and uniform linking of selective illumination of one or more light sources with one or more inputs, including network inputs.

SUMMARY

The present disclosure is directed to inventive methods and apparatus for lighting control. For example, various inventive methods, systems, apparatus and computer-readable media disclosed herein relate to linking selective illumination of one or more light sources with states of one or more inputs.

Generally, in one aspect, a method of linking selective illumination of a lighting element to input may include rendering, by a computing device on a display of the computing device, a source graphical element that represents the input and a sink graphical element that represents the lighting element. The method may further include receiving, at a user input of the computing device, an instruction to alter one of the source and sink graphical elements to be within a predetermined proximity of the other of the source and sink graphical elements on the display. The method may further include linking, by the computing device, selective illumination of the lighting element to a state of the input while the source and sink graphical elements are within the predetermined proximity of each other on the display.

In various embodiments, the linking may include linking selective illumination of the lighting element to a state of the input while one of the source and sink graphical elements at least partially overlaps the other. In various embodiments, the source graphical element may be a distribution of color over an area of the display.

In various embodiments, the method may further include selectively rendering an appearance of the source graphical element on the display based on the state of the input. In various embodiments, the method may further include selectively rendering an appearance of the sink graphical element on the display based on a state of the lighting element.

In various embodiments, the input may include data sensed by one or more sensors of a mobile computing device. In various embodiments, the input may include a user's mood or status obtained from a social network or online calendar. In various embodiments, the selective illumination may include selective illumination of the lighting element to emit light of a particular hue based on the state of the input. In various embodiments, the input may include an indication of whether a particular event has occurred.

In various embodiments, the input may be a first input, the source graphical element may represent a plurality of inputs that includes the first input, and the linking may include linking, by the computing device, selective illumination of the lighting element to states of the plurality of inputs. In various versions, the selective illumination may include selection of two or more properties of light emitted by the lighting element based on states of two or more of the plurality of inputs.

In various embodiments, the lighting element may include a first lighting element, the sink graphical element may represent a plurality of lighting elements that includes the first lighting element, and the linking may include linking, by the computing device, selective illumination of the plurality of lighting elements to the state of the input.

In various embodiments, the linking may include linking, by the computing device, selective illumination of the lighting element to a sequence of states of the input. In various embodiments, the linking may include linking, by the computing device, selective illumination of the lighting element to a time-shifted state of the input.

In various embodiments, the selective illumination may include selecting a property of light emitted by the lighting element based on a degree of proximity between the source graphical element and the sink graphical element.

In various embodiments, at least one non-transitory computer-readable medium may include instructions that, in response to execution of the instructions by the computing device, cause the computing device to perform one or more selected operations of the above-described methods.

In another aspect, a linking computing device may include one or more processors, a display operably coupled with the one or more processors, and memory storing instructions. Execution of the instructions by the one or more processors may cause the one or more processors to render, on the display, a source graphical element that represents an input and a sink graphical element that represents a lighting element, and link selective illumination of the lighting element to a state of the input in response to a determination that the source and sink graphical elements are within a predetermined proximity of each other on the display.

In various embodiments, the determination may include a determination that one of the source and sink graphical elements at least partially overlaps the other. The source graphical element may include a distribution of color over an area of the display. Also, the instructions, in response to execution by the one or more processors, may further cause the one or more processors to selectively render an appearance of the source graphical element or the sink graphical element on the display based on the state of the input.

In various embodiments, the input may include data sensed by one or more sensors of a mobile computing device. In various embodiments, the input may include a user's mood or status obtained from a social network or online calendar. In various embodiments, the selective illumination may include selective illumination of the lighting element to emit light of a particular hue based on the state of the input.

In various embodiments, the input may include an indication of whether a particular event has occurred. In various embodiments, the input may include a first input, the source graphical element may represent a plurality of inputs that includes the first input, and the link may include link selective illumination of the lighting element to states of the plurality of inputs.

The selective illumination may include selection of two or more properties of light emitted by the lighting element based on states of two or more of the plurality of inputs. In various embodiments, the lighting element may include a first lighting element, the sink graphical element may represent a plurality of lighting elements that includes the first lighting element, and the link may include link selective illumination of the plurality of lighting elements to the state of the input.

In various embodiments, the link may include link selective illumination of the lighting element to a sequence of states of the input. In various embodiments, the link may include link selective illumination of the lighting element to a time-shifted state of the input.

As used herein for purposes of the present disclosure, the term "LED" should be understood to include any electroluminescent diode or other type of carrier injection/junction-based system that is capable of generating radiation in response to an electric signal. Thus, the term LED includes, but is not limited to, various semiconductor-based structures that emit light in response to current, light emitting polymers, organic light emitting diodes (OLEDs), electroluminescent strips, and the like. In particular, the term LED refers to light emitting diodes of all types (including semi-conductor and organic light emitting diodes) that may be configured to generate radiation in one or more of the infrared spectrum, ultraviolet spectrum, and various portions of the visible spectrum (generally including radiation wavelengths from approximately 400 nanometers to approximately 700 nanometers).

For example, one implementation of an LED configured to generate essentially white light (e.g., a white LED) may include a number of dies which respectively emit different spectra of electroluminescence that, in combination, mix to form essentially white light. In another implementation, a white light LED may be associated with a phosphor material that converts electroluminescence having a first spectrum to a different second spectrum. In one example of this implementation, electroluminescence having a relatively short wavelength and narrow bandwidth spectrum "pumps" the phosphor material, which in turn radiates longer wavelength radiation having a somewhat broader spectrum.

The term "light source" should be understood to refer to any one or more of a variety of radiation sources, including, but not limited to, LED-based sources (including one or more LEDs as defined above). To avoid confusion with "source graphical elements" described herein, a light source may alternatively be referred to as a "lighting element."

A given light source may be configured to generate electromagnetic radiation within the visible spectrum, outside the visible spectrum, or a combination of both. Hence, the terms "light" and "radiation" are used interchangeably herein. Additionally, a light source may include as an integral component one or more filters (e.g., color filters), lenses, or other optical components. Also, it should be understood that light sources may be configured for a variety of applications, including, but not limited to, indication, display, and/or illumination. An "illumination source" is a light source that is particularly configured to generate radiation having a sufficient intensity to effectively illuminate an interior or exterior space. In this context, "sufficient intensity" refers to sufficient radiant power in the visible spectrum generated in the space or environment (the unit "lumens" often is employed to represent the total light output from a light source in all directions, in terms of radiant power or "luminous flux") to provide ambient illumination (i.e., light that may be perceived indirectly and that may be, for example, reflected off of one or more of a variety of intervening surfaces before being perceived in whole or in part).

The term "spectrum" should be understood to refer to any one or more frequencies (or wavelengths) of radiation produced by one or more light sources. Accordingly, the term "spectrum" refers to frequencies (or wavelengths) not only in the visible range, but also frequencies (or wavelengths) in the infrared, ultraviolet, and other areas of the overall electromagnetic spectrum. Also, a given spectrum may have a relatively narrow bandwidth (e.g., a FWHM having essentially few frequency or wavelength components) or a relatively wide bandwidth (several frequency or wavelength components having various relative strengths).

It should also be appreciated that a given spectrum may be the result of a mixing of two or more other spectra (e.g., mixing radiation respectively emitted from multiple light sources).

For purposes of this disclosure, the term "color" is used interchangeably with the term "spectrum." However, the term "color" generally is used to refer primarily to a property of radiation that is perceivable by an observer (although this usage is not intended to limit the scope of this term). Accordingly, the terms "different colors" implicitly refer to multiple spectra having different wavelength components and/or bandwidths. It also should be appreciated that the term "color" may be used in connection with both white and non-white light.

The term "color temperature" generally is used herein in connection with white light, although this usage is not intended to limit the scope of this term. Color temperature essentially refers to a particular color content or shade (e.g., reddish, bluish) of white light. The color temperature of a given radiation sample conventionally is characterized according to the temperature in degrees Kelvin (K) of a black body radiator that radiates essentially the same spectrum as the radiation sample in question. Black body radiator color temperatures generally fall within a range of from approximately 700 degrees K (typically considered the first visible to the human eye) to over 10,000 degrees K; white light generally is perceived at color temperatures above 1500-2000 degrees K.

An "LED-based lighting unit" refers to a lighting unit that includes one or more LED-based light sources as discussed above, alone or in combination with other non LED-based light sources. A "multi-channel" lighting unit refers to an LED-based or non LED-based lighting unit that includes at least two light sources configured to respectively generate different spectrums of radiation, wherein each different source spectrum may be referred to as a "channel" of the multi-channel lighting unit.

The term "controller" is used herein generally to describe various apparatus relating to the operation of one or more light sources. A controller can be implemented in numerous ways (e.g., such as with dedicated hardware) to perform various functions discussed herein. A "processor" is one example of a controller which employs one or more microprocessors that may be programmed using software (e.g., microcode) to perform various functions discussed herein. A controller may be implemented with or without employing a processor, and also may be implemented as a combination of dedicated hardware to perform some functions and a processor (e.g., one or more programmed microprocessors and associated circuitry) to perform other functions. Examples of controller components that may be employed in various embodiments of the present disclosure include, but are not limited to, conventional microprocessors, application specific integrated circuits (ASICs), and field-programmable gate arrays (FPGAs).

In various implementations, a processor or controller may be associated with one or more storage media (generically referred to herein as "memory," e.g., volatile and non-volatile computer memory such as RAM, PROM, EPROM, and EEPROM, floppy disks, compact disks, optical disks, magnetic tape, etc.). In some implementations, the storage media may be encoded with one or more programs that, when executed on one or more processors and/or controllers, perform at least some of the functions discussed herein. Various storage media may be fixed within a processor or controller or may be transportable, such that the one or more programs stored thereon can be loaded into a processor or controller so as to implement various aspects of the present invention discussed herein. The terms "program" or "computer program" are used herein in a generic sense to refer to any type of computer code (e.g., software or microcode) that can be employed to program one or more processors or controllers.

The term "network" as used herein refers to any interconnection of two or more devices (including controllers or processors) that facilitates the transport of information (e.g. for device control, data storage, data exchange, etc.) between any two or more devices and/or among multiple devices coupled to the network. As should be readily appreciated, various implementations of networks suitable for interconnecting multiple devices may include any of a variety of network topologies and employ any of a variety of communication protocols. Additionally, in various networks according to the present disclosure, any one connection between two devices may represent a dedicated connection between the two systems, or alternatively a non-dedicated connection. In addition to carrying information intended for the two devices, such a non-dedicated connection may carry information not necessarily intended for either of the two devices (e.g., an open network connection). Furthermore, it should be readily appreciated that various networks of devices as discussed herein may employ one or more wireless, wire/cable, and/or fiber optic links to facilitate information transport throughout the network.

The term "user interface" as used herein refers to an interface between a human user or operator and one or more devices that enables communication between the user and the device(s). Examples of user interfaces that may be employed in various implementations of the present disclosure include, but are not limited to, switches, potentiometers, buttons, dials, sliders, a mouse, keyboard, keypad, various types of game controllers (e.g., joysticks), track balls, display screens, various types of graphical user interfaces (GUIs), touch screens, microphones and other types of sensors that may receive some form of human-generated stimulus and generate a signal in response thereto.

As used herein, "selective illumination," "selectively illuminating," and other similar terms may refer to causing one or more light sources to emit light with one or more selected properties. These properties may include but are not limited to a selected hue, saturation, brightness, animation, temperature, carried signal (e.g., coded light signals), and so forth. A light source may be selectively illuminated based on various inputs, such as network inputs. For instance, a light source (also referred to as a "lighting element") may be linked to a user's mood and/or social network status (or more generally, a text string that a remote user has sent to a networked status variable, representing the users state), and may be selectively illuminated so that light it emits has one hue for one user emotion (e.g., blue for happy), another hue for another user emotion (e.g., red for angry), and so forth.

The term "input" as used herein may refer to anything source of data and/or a state. Inputs may include whether an even or sequence of event has occurred, sensor data, and so forth. Inputs may be local, e.g., a user's local calendar, whether she is currently typing, a state of her computing device, her GPS coordinates, a rate of speed (e.g., measured by an accelerometer), etc. Additionally or alternatively, an input may be a network input. Network inputs may include remote sources of states, such as social network statuses or moods, network variables that may be automatically or manually set by the user or by others, online calendars or schedules, remote light sources, a remotely reported location of a user's smart phone, and so forth.

It should be appreciated that all combinations of the foregoing concepts and additional concepts discussed in greater detail below (provided such concepts are not mutually inconsistent) are contemplated as being part of the inventive subject matter disclosed herein. In particular, all combinations of claimed subject matter appearing at the end of this disclosure are contemplated as being part of the inventive subject matter disclosed herein. It should also be appreciated that terminology explicitly employed herein that also may appear in any disclosure incorporated by reference should be accorded a meaning most consistent with the particular concepts disclosed herein.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the invention.

DETAILED DESCRIPTION

Various technologies may facilitate selective illumination of a light source based on an input. A user wishing to use more than one of these technologies may be faced with myriad different techniques for linking an input to a light source that, while perhaps user friendly on an individual basis, collectively may be cumbersome. Similarly, the user may desire easy manual control of the light sources. Thus, there is a need in the art for systems, methods, devices, apparatus and computer-readable media (transitory and non-transitory) to provide easy and uniform linking of selective illumination of one or more light sources with one or more inputs.

In view of the foregoing, various embodiments and implementations of the present invention are directed to linking selective illumination of a light source with one or more inputs. For example, a computing device may render on a display (e.g., an ambient touchscreen) a source graphical element that represents an input and a sink graphical element that represents a light source. A user may provide an instruction to alter one or more of the source and sink graphical elements to be within a predetermined proximity of the other of the source and sink graphical elements on the display. For instance, the user may drag her finger across a touch screen to move a source graphical element to overlap a sink graphical element, or vice versa. This overlap may link selective illumination of the light source to a state of the input.

Figure 1:
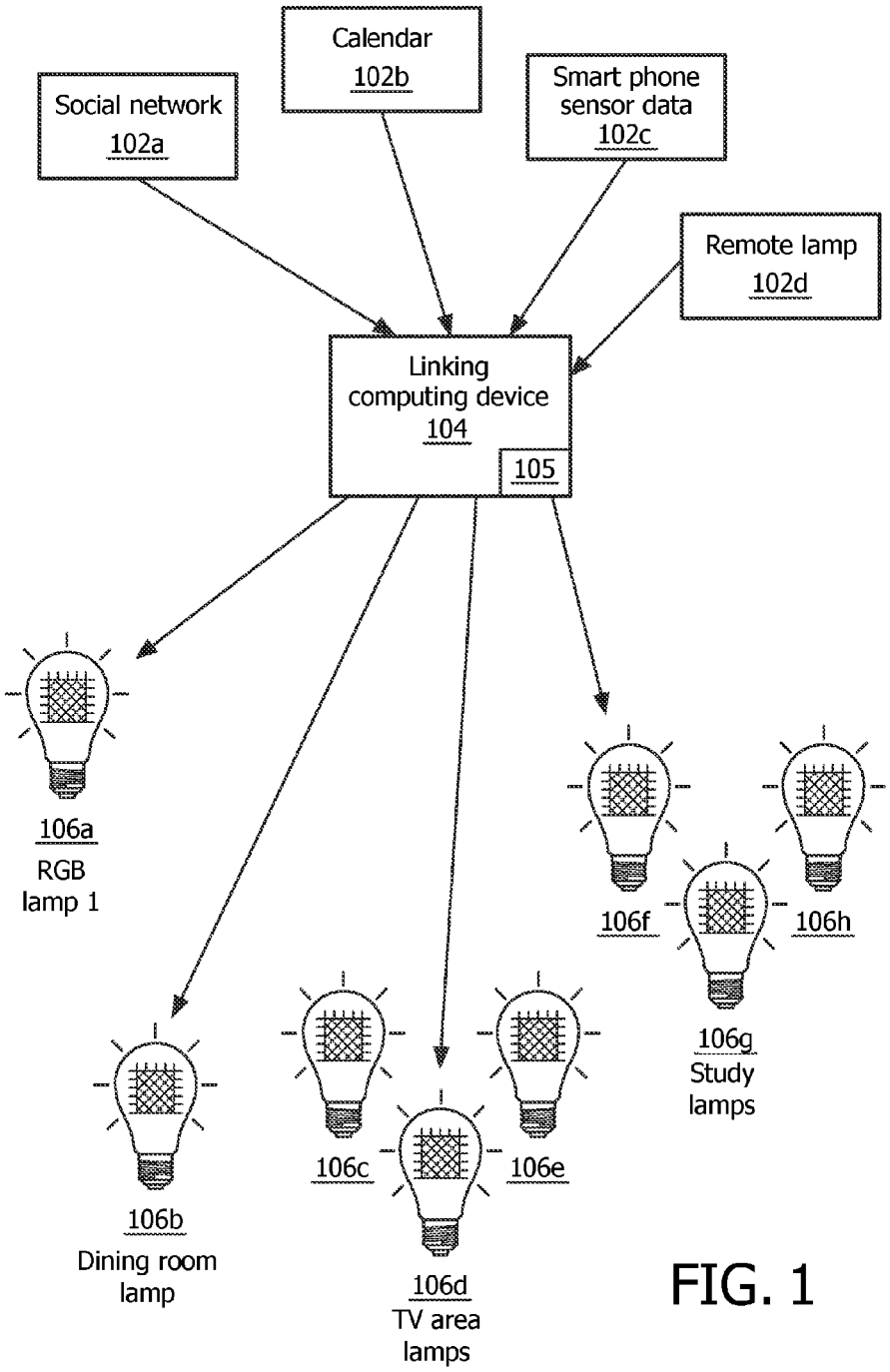
FIG. 1 schematically depicts example components that together may facilitate linking of selective illumination of one or more lighting elements with one or more inputs, in accordance with various embodiments.

Referring to FIG. 1, in one embodiment, inputs 102 may include a social network 102*a*, a calendar 102*b* (online or local), a smart phone sensor data 102*c* and/or one or more remote lamps 102*d*. These inputs are for illustrative purposes only. More or less other inputs may be provided. A linking computing device 104 may be configured, e.g., by way of one or more processors 105, to be operated by a user (not shown) to link light sources 106*a-h* with the one or more inputs 102*a-d*. In various embodiments, linking computing device 104 may be a laptop or desktop computer, a tablet computer, a smart phone, a set-top box connected to a television, and so forth. In various embodiments, linking computing device 104 may be an ambient computing device. In various embodiments, linking computing device 104 may be a remote server. A user may operate a local computing device such as a laptop, smart phone, tablet, or a dedicated ambient computing device, to interact with the remote linking computing device 104 over one or more networks.

Light sources 106 may include individual light sources such as an RGB lamp 106*a* and a dining room lamp 106*b* for which selective illumination may be individually linked to one or more inputs 102*a-d*. Light sources 106 may also include groups of light sources, e.g., clusters of light sources that are proximate to each other. For example, light sources 106*c-e* are designated "TV area" lamps and light sources 106*f-h* are designated "study lamps." Selective illumination of these groups of light sources may be collectively linked to one or more inputs.

For instance, a user may operate linking computing device 104, e.g., by touching a touchscreen display (not shown in FIG. 1), to link selective illumination of "study lamps" light sources 106*f-h* to "SOCIAL NETWORK" input 102*a*. This may result in a state of the user's mood and/or social network status dictating one or more properties of light output by light sources 106*f-h*. As another example, a user may operate linking computing device 104, e.g., by touching its touchscreen display, to link selective illumination of "DINING ROOM LAMP" light source 106*b* to input 102*d* designated "REMOTE LAMP." This may result in an illumination state of the remote lamp (e.g., on, off, emitting ambient light, etc.) dictating one or more properties of light output by light source 106*b*.

For example, assuming input 102*a* and "study lamps" are linked, if the user's status is "watching movie," light sources 106*f-h* may emit low or ambient lighting that enhances the mood of the study for movie watching. If the user's status is "doing homework," on the other hand, then light sources 106*f-h* may emit brighter, working light. As another example, if the user's status is "gaming," that may suggest the user is in his study playing video games. Light sources 106*f-h* may be selectively illuminated to emit light in a manner that enhances the gaming experience. For instance, when there is an explosion in the game, light sources 106*f-h* may briefly emit intensely bright light. If the user's gaming avatar is proceeding through a dark area, such as a sewer or dungeon, light sources 106*f-h* may emit little or no light. If the user is playing a game that involves music (e.g., mimicking guitar playing), light sources 106*f-h* may emit light that mimics concert lighting.

If the user wishes to disassociate light sources 106*f-h* from "SOCIAL NETWORK" input 102*a*, the user may operate linking computing device 104 accordingly. For example, the user may operate an ambient touchscreen to drag a graphical element associated with SOCIAL NETWORK input 102*a*, referred to herein as a "source graphical element," away from a graphical element associated with "study lamps" light sources 106*f-h*, referred to herein as a "sink graphical element."

Figure 2:
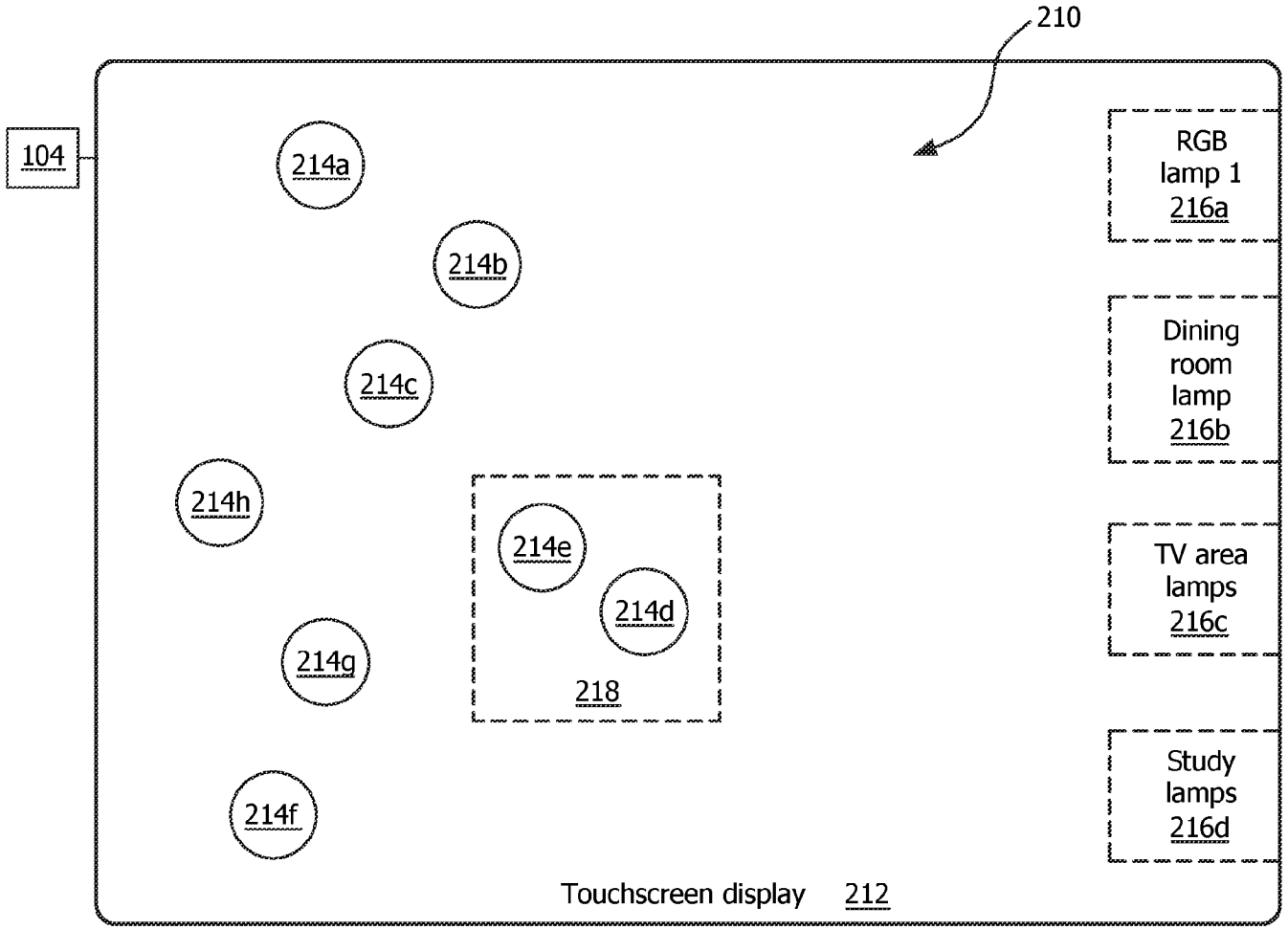
FIGS. 2-3 schematically illustrate an example interface that facilitates linking of selective illumination of one or more lighting elements with one or more inputs, in accordance with various embodiments.

FIG. 2 schematically depicts an example user interface 210 that may be rendered on a touchscreen display 212 by linking computing device 104. User interface 210 may be operable by a user to link selective illumination of one or more light sources, such as light sources 106*a-h*, to one or more inputs, such as inputs 102*a-d*. While in examples herein, touchscreen display 212 is depicted as a flat screen, this is not meant to be limiting. In various embodiments, touchscreen display 212 may come in other two- and three-dimensional shapes, such as spherical, semi-spherical, elliptical, conical, cubical, two- and/or three-dimensional shapes projected onto surfaces, and so forth.

A plurality of source graphical elements 214 may be associated with a plurality of inputs (e.g., 102*a-d* in FIG. 1). A plurality of sink graphical elements 216 may be associated with a plurality of light sources (e.g., 106*a-h* in FIG. 1). In FIG. 2, source graphical elements 214 are icons 214*a-h* that a user may touch and drag across touchscreen display 212. Sink graphical elements 216 are designated areas 216*a-d* of touchscreen display 212 onto which source graphical elements 214 may be dragged to link the associated inputs with one or more associated light sources. Sink graphical elements 216 are shown in dashed lines for clarity's sake; there may or may not be such delineating graphics on an actual display, and in embodiments that utilize ambient displays, there likely would not be such a delineating graphic.

A box 218 is depicted around two source graphical elements, 214*d* and 214*e*. Box 218 may be created by a user, e.g., by dragging a box around multiple graphical elements, to create a group or "cluster" of graphical elements that may be moved together towards or away from one or more sink graphical elements 216. In some embodiments, related inputs (e.g., moods of friends, family members, celebrities, etc.) may be grouped together, automatically or manually by the user. As another example, similar types of inputs, such as social network statuses, remote light sources, derived colors from social network posts, and so forth, may be grouped together.

The arrangement depicted in FIG. 2 is not meant to be limiting. In various embodiments, sink graphical elements 216 may be icons that may be dragged onto source graphical elements 214, and source graphical elements 214 may be areas or icons. Moreover, while source graphical elements 214 and sink graphical elements 216 of FIG. 2 are shown as discrete graphical icons and areas, respectively, this is not meant to be limiting. In various embodiments, user interface 210 may be rendered in the form of an ambient display. In such case, source and/or sink graphical elements may comprise areas of touchscreen display 212 with pixels collectively illuminated to form a particular color distribution. A user may "drag" such an area towards another area, which may similarly include pixels collectively illuminated to form a particular color distribution. In some embodiments, an abstraction level of graphical elements, e.g., whether source and sink graphical elements are discrete, easily discernible icons or areas of an ambient display rendering a continuous color pattern, may be adjusted to a user's preferences.

Figure 3:
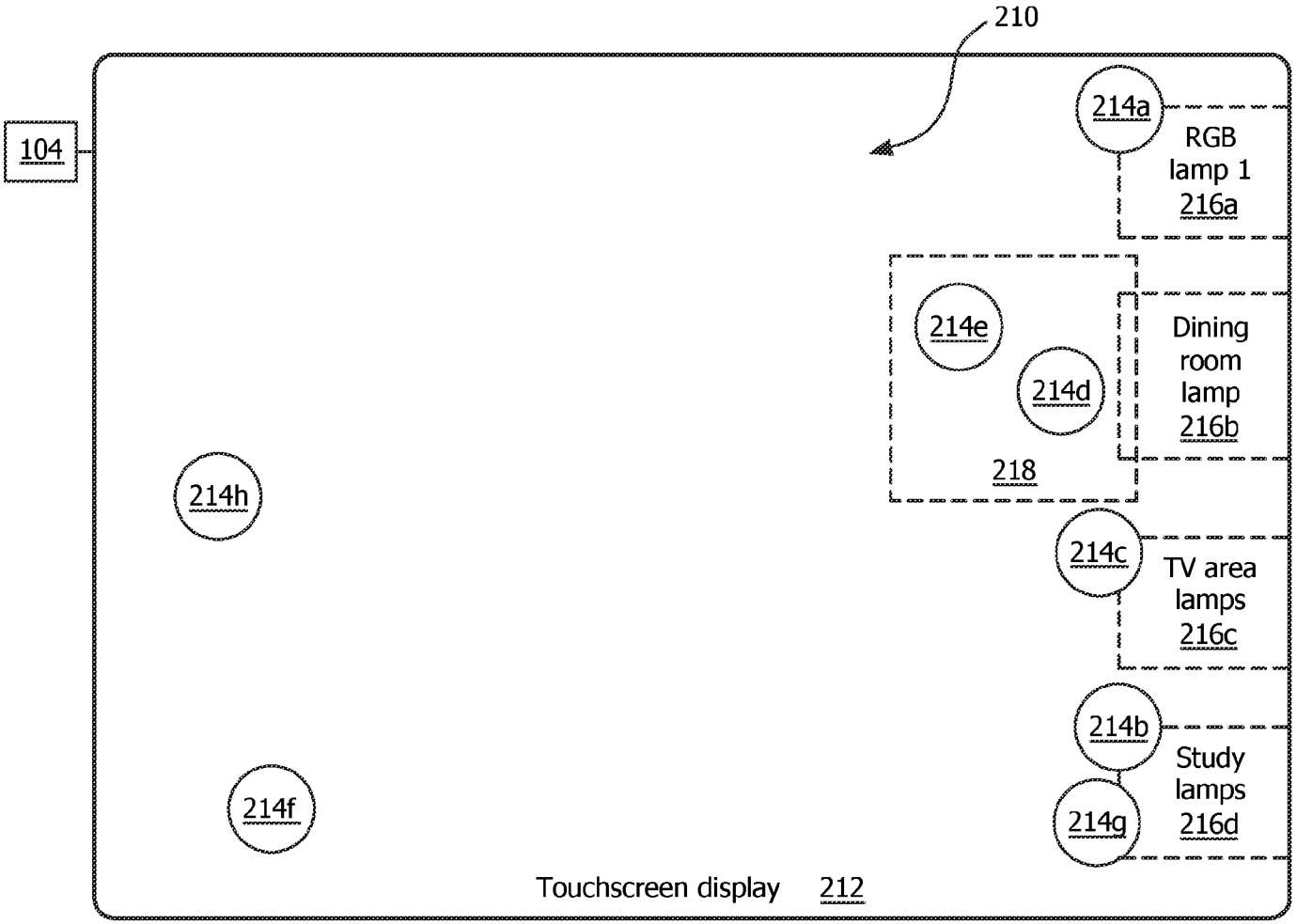

FIG. 3 depicts one example of how components of user interface 210 of FIG. 2 may be operated by a user to link selective illumination of one or more light sources to one or more inputs. Source graphical element 214*a* has been dragged to the right to partially overlap sink graphical area 216*a* associated with "RGB LAMP 1." While these graphical elements overlap, the light source designated "RGB LAMP 1" may be selectively illuminated based on a state of an input associated with source graphical element 214*a*.

Source graphical elements 214*b* and 214*g* have both been dragged to the right to partially overlap sink graphical element 216*d* associated with "BASEMENT LAMPS." Dragging multiple source graphical elements 214 onto a single sink graphical element 216 may link selective illumination of one or more light sources associated with the sink graphical element 216 to states of multiple inputs associated with the multiple source graphical elements 214. For example, one property of light emitted by lamps in the study, e.g., hue, intensity level of a lighting effect projected onto a surface, color channel (e.g., red, green or blue), etc., may be selected based on an input associated with source graphical element 214*b*. Another property of light emitted by lamps in the study, e.g., saturation, may be selected based on an input associated with source graphical element 216*g*. Additionally or alternatively, selective illumination of individual light sources associated with sink graphical element 216*d* may be individually linked to inputs associated with source graphical elements 214, e.g., in the order that source graphical elements 214 were dragged onto sink graphical element 216*d*.

Source graphical elements 214*d* and 214*e* have both been dragged to the right, e.g., as a result of box 218 being dragged to the right, so that box 218 partially overlaps sink graphical area 216*b* associated with "DINING ROOM LAMP." Dragging multiple source graphical elements 214 onto a single sink graphical element 216 associated with a single light source (e.g., the light source designated "DINING ROOM LAMP") may link selective illumination of that light source to states of multiple inputs associated with the multiple source graphical elements 214. For example, one property of light emitted by the dining room lamp, e.g., a carried coded light signal, may be selected based on an input associated with source graphical element 214*d*. Another property of light emitted by the dining room lamp, e.g., saturation, may be selected based on an input associated with source graphical element 216*e*.

Source graphical element 214*c* has been dragged to the right to partially overlap sink graphical element 216*c* associated with "TV AREA LAMPS." Dragging a single source graphical element 214 onto a sink graphical element 216 associated with multiple light sources may link selective illumination of the multiple light sources to a state of the input associated with the single source graphical element 214. In the context of FIG. 3, multiple light sources in the TV area may be selectively illuminated based on a state of an input associated with source graphical element 214*c*. For example, assuming source graphical element 214*c* is associated with a user's social networking status, if the user's status is "watching scary movie," then multiple light sources in the TV area may emit light with properties conducive to watching a scary movie, e.g., low lighting, briefly flashing when lightning strikes in the movie, etc.

While in FIG. 3, source graphical elements 214 are shown dragged to at least partially overlap sink graphical elements 216 to link selectively illumination of light sources with inputs, this is not meant to be limiting. In some embodiments, overlap of graphical elements is not required. Rather, a degree of proximity between graphical elements may dictate a degree of linking of selective illumination between corresponding light sources and inputs. For instance, if a source graphical element 214 is dragged to within a predetermined proximity of a sink graphical element 216, then selective illumination of one or more light sources associated with the sink graphical element 216 may be linked to one or more inputs associated with the source graphical element 214. As the graphical elements are separated (e.g., by dragging one away from the other), selective illumination of the one or more light sources may become less based on the one or more inputs. For example, in FIG. 3, if source graphical element 214*h* were dragged gradually closer to sink graphical element 216*a*, an effect of an input associated with source graphical element 214*h* may have a gradually-increasing effect on selective illumination of the light source designated "RGB LAMP 1."

As noted above, multiple graphical elements may be dragged to overlap a single graphical element. In some embodiments, multiple graphical elements may be dragged to be within various proximities of a particular graphical element to cause various levels of influence on selective illumination of a light source. For instance, assume that an input associated with source graphical element 214*a* in FIG. 3 has a state that is associated with the color red, and that an input associated with source graphical element 214*f* has a state that is associated with the color blue. In the configuration shown in FIG. 3, only source graphical element 214*a* overlaps or is nearby sink area 216*a*. Consequently, the light source designated "RGB LAMP 1" may be selectively illuminated to emit red light. However, if source graphical element 214*f* were dragged to overlap or be sufficiently near sink graphical element 216*a*, then its corresponding input's blue state may cause the light source designated "RGB LAMP 1" to combine the effects of both inputs, e.g., by alternating between emitting red and blue light and/or mixing blue and red light to emit purple light.

To aid in making operation of graphical user interface 210 intuitive to a user, in various embodiments, graphical elements may be rendered in a manner that is related to a state of an input or light source. For instance, linking computing device 104 may be configured to selectively render an appearance of source graphical elements 214 on touchscreen display 212 based on states of corresponding inputs. Thus, in FIG. 3, if source graphical element 214*a* were linked to a user's online calendar (e.g., 102*b* in FIG. 1), then it may be rendered in red if the user is currently busy and blue if the user is currently available.

Likewise, linking computing device 104 may be configured to selectively render an appearance of sink graphical elements 216 on touchscreen display 212 based on states of corresponding light sources. Thus, in FIGS. 2 and 3, if the light source designated "DINING ROOM LAMP" is illuminated, an appearance of corresponding sink graphical element 216*b* (e.g., a border, pixels in the area, etc.) may be rendered in yellow or white, whereas if the light source designated "DINING ROOM LAMP" is not illuminated, an appearance of corresponding sink graphical element 216*b* may be rendered in blue or another darker color.

In some embodiments, when selective illumination of multiple light sources associated with a sink graphical element 216 are linked to a single input, those multiple light sources may be linked to a sequence of states of the input. For example, assume that instead of being associated with a user's social networking status, source graphical element 214*c* is associated with one or more sensors (e.g., GPS, accelerometer, gyroscope, calendar, etc.) on the user's smart phone. One light source in the TV area may illuminate when the user's smart phone is within a predetermined distance of the user's home (e.g., as measured by the smart phone's GPS or other similar means). This may provide light to the user as she enters her house. Another light source in the TV area may illuminate if the user actually enters the TV area, to provide further illumination. Additionally or alternatively, multiple light sources in the TV area may be selectively illuminated to have a relatively low intensity when the user's smart phone is within a predetermined distance of the user's home, and to have a relatively high intensity when the user actually enters her home. Other selective illumination schemes may be implemented based on other sequences of a single input, or even on sequences of multiple inputs.

In some embodiments, a state of an input may include whether a particular event has occurred. Selective illumination of one or more light sources associated with one or more sink graphical elements 216 that overlaps a source graphical element 214 corresponding to such an input may be based on occurrence of that event. For example, assume Bob is waiting for a text message from Tom, and that Bob needs to take a shower and does not want his phone getting wet. Bob may operate linking computing device 104 to create and/or drag a source graphical element 214 representing receipt of Tom's text message towards a sink element representing the light source near the shower. When Tom's text message arrives on Bob's phone, the source graphical element 214 on touchscreen display 212 may be selectively illuminated to have an appearance that indicates that Tom's message has arrived. Likewise, the linked light source near Bob's shower may be selectively illuminated to notify Bob that Tom's text message has arrived. In some cases, sink graphical element 216 on linking device 104 may also be selectively rendered to have an appearance indicative of the light source being selectively illuminated.

In some embodiments, selective illumination of a light source may be linked to a time-shifted state of an input. For example, in the above example, assume Bob lives in a time zone that is three hours behind Tom's. If Tom sends the message at 8 am his time, the message may arrive at Bob's phone at 5 am Bob's time. Bob likely would not yet be awake, and may not wish to be disturbed at such an early hour. Accordingly, linking computing device 104 may automatically, or manually at Bob or Tom's request, add a time shift to the input representing receipt of Tom's text message so that the selective illumination of a light source that is linked to the input is delayed three hours. Of course, other time intervals may be used as delays as appropriate.

As noted above, in some embodiments, multiple source graphical elements 214 may be operated so that their multiple corresponding inputs may collectively be linked to selective illumination of a light source. Those multiple inputs may collectively influence selective illumination of a light source in various ways. For example, continuing the above example, assume that two source graphical elements 214, one representing Bob's mood and the other representing his online calendar, are dragged towards a sink graphical element 216 representing a particular light source, linking it to these two inputs. While Bob's mood has a state of "awake" or "attentive," arrival of Tom's text message may immediately trigger the light source to be illuminated in a particular manner. However, if Bob's schedule simultaneously says he is busy, which would cause illumination of the light source to be delayed until Bob's calendar indicates he is available, a conflict arises. To address this, in some embodiments, inputs may be assigned priorities. Thus, for instance, if Bob gives the course graphical element 214 representing his mood a higher priority than the source graphical element 214 representing his calendar, the light source may be illuminated in spite of the fact that Bob's calendar says he's busy.

In various embodiments, a density of inputs associated with a source graphical element 214 or a group of source graphical elements 214 may be different than a density of light sources associated with a sink graphical element 216 or group thereof onto which the source graphical element(s) 214 is dragged. For instance, the sink graphical element 216 may represent a far higher number of light sources than there are inputs associated with the source graphical element(s) 214. In such case, the plurality of light sources associated with the sink graphical element(s) 216 may be selectively illuminated to interpolate data from the inputs over the plurality of light sources.

For instance, assume a group of three source graphical elements 214 representing three separate inputs is dragged onto a sink graphical element 216 corresponding to control parameters for a light tile. The light tile may have many light sources (e.g., 12×12 rgb pixels), whereas there are only three inputs represented by the three graphical elements. In various embodiments, a spatial or other relationship between the source graphical elements 214 may be used to interpolate how the light tile is to be selectively illuminated. In some embodiments, it may be an option for the user to see on touchscreen display 214 a representation of the three source graphical elements 214 (e.g., three pixels) or a derivation thereof (color distribution for 12×12 rgb pixels) in the representation of the three source graphical elements 214 on the light tile. In some embodiments, if the reverse is true—i.e. a density of inputs represented by source graphical elements 214 is greater than a density of light sources represented by a sink graphical element 216—"extra" inputs may be used to drive lighting properties such as dynamic animation, emphasis of particular lighting properties, etc.

In some embodiments, linking computing device 104 may cause an area of touchscreen display 212 to be "neutral" (not depicted in FIGS. 2-3). Graphical elements dragged into this neutral area may have little or no influence over other graphical elements, inputs and/or light sources. Assume a user wishes that a particular friend's social networking status have no effect on any light source. The user may drag a source graphical element 214 associated with that friends social network status to the neutral area, effectively disconnecting that input from any light source. Similarly, if the user wishes that a particular light source be unaffected by any input, the user may drag the corresponding sink graphical element 216 into the neutral area. In some embodiments, multiple graphical elements in the neutral area may not affect light sources or inputs associated with other graphical elements in neutral area.

One example of an input that may be selectively linked to selective illumination of one or more light sources using techniques described herein is a sensor related to a remote user. For example, a user may drag a source graphical element 214 corresponding to a sensor associated with a user's elderly relative to a sink graphical element 216 corresponding to a particular light source. If the user does not see the light source come on (or otherwise be selectively illuminated in a particular manner) for long enough, the user may be reminded to check in on the elderly relative, to make sure everything is OK.

Figure 4:
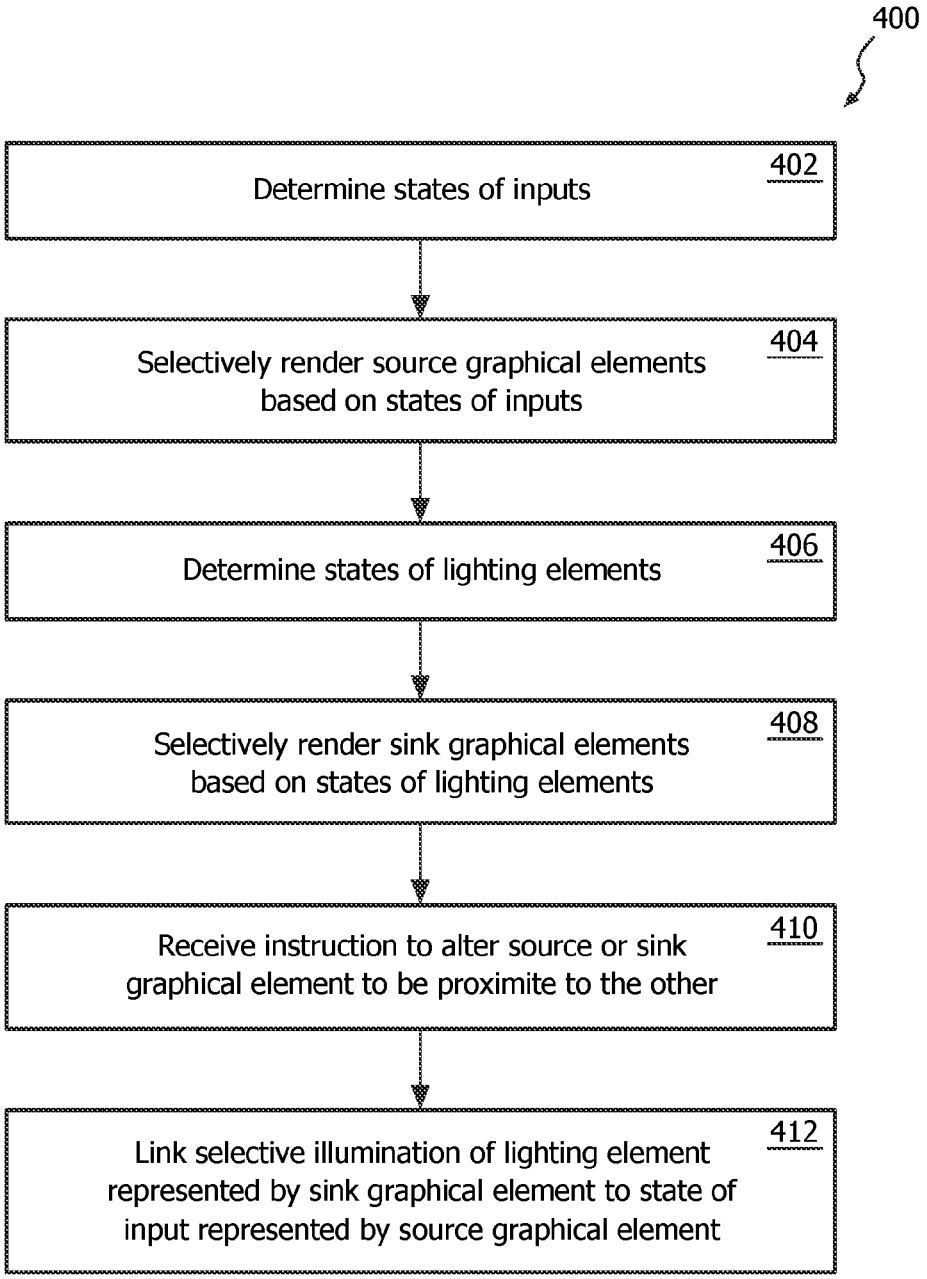
FIG. 4 depicts an example method that may be implemented by a linking computing device, in accordance with various embodiments.

FIG. 4 schematically depicts an example method 400 that may be implemented, e.g., by linking computing device 104, in accordance with various embodiments. At block 402, states of one or more inputs may be determined. For example, linking computing device 104 may determine a user's status or mood, e.g., from a social network, and may determine a user's current activity based on an online calendar associated with the user.

At block 404, one or more source graphical elements 214 may be selectively rendered on touchscreen display 212 of linking computing device 104, based on the input states determined at block 402. The one or more source graphical elements 214 may represent inputs. As noted above, appearances the source graphical elements may be selective rendered based on the respective states of inputs. For example, if a user's mood is "sad," then the corresponding source graphical element 214 may be rendered to include pixels with a color associated with sadness, e.g., blue.

At block 406, states of one or more light sources may be determined. For example, linking computing device 104 may determine that a particular light source is turned on, emitting a particular color, emitting a particular coded light signal, etc. At block 408, an appearance of one or more sink graphical elements 216 may be selectively rendered on touchscreen display 212 of linking computing device 104, based on the light source states determined at block 406. For example, if a light source is on, then the corresponding sink graphical element 216 may be rendered to include pixels with bright colors, e.g., white or yellow. Likewise, if the light source is twinkling or otherwise being illuminated to emit light that coincides with effects in a movie, the corresponding sink graphical element 216 may be rendered to include pixels that correspondingly twinkle or light up to coincide with the movie effects.

At block 410, an instruction to alter one of the source and sink graphical elements to be within a predetermined proximity of the other of the source and sink graphical elements on the display may be received, e.g., at touchscreen display 212 of linking computing device 104. For example, a user may touch a source or sink graphical element and "drag" it to another portion of touchscreen display 212, e.g., closer to or overlapping another source or sink graphical element.

At block 412, selective illumination of the light source may be linked to a state of the input, e.g., while the source and sink graphical elements 214 and 216 are within the predetermined proximity (e.g., overlapping) of each other on touchscreen display 212. In some embodiments, linking computing device 104 may cause data obtained from an input represented by the source graphical element 214 such as a social network to be passed to an input of one or more light sources represented by the sink element 216. The light source may then determine how to selectively illuminate based on the data provided by linking computing device 104. In other embodiments, linking computing device 104 may include in its memory or elsewhere mappings between states of various inputs and illumination options of various light sources. These mappings may be configured by a user when the user operates source graphical elements 214 and sink graphical elements 216 as described above. Based on these mappings, linking computing device 104 may translate incoming data received from an input to an appropriate instruction to cause a particular light source to emit light with particular properties.

While several inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified.

It should also be understood that, unless clearly indicated to the contrary, in any methods claimed herein that include more than one step or act, the order of the steps or acts of the method is not necessarily limited to the order in which the steps or acts of the method are recited. Also, reference numerals appearing in the claims, if any, are provided merely for convenience and should not be construed as limiting the claims in any way.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively.

The invention claimed is:

1. A method of linking selective illumination of a lighting element to input, comprising:

rendering, by a computing device on a display of the computing device, a source graphical element that represents the input and a sink graphical element that represents the lighting element;

receiving, at a user input of the computing device, an instruction to alter one of the source and sink graphical elements to be within a predetermined proximity of the other of the source and sink graphical elements on the display; and linking, by the computing device, selective illumination of the lighting element to a state of the input while the source and sink graphical elements are within the predetermined proximity of each other on the display, wherein the input comprises a user's mood or status obtained from a social network or calendar.

2. The method of claim 1, wherein the linking comprises linking selective illumination of the lighting element to a state of the input while one of the source and sink graphical elements at least partially overlaps the other.

3. The method of claim 1, wherein the source graphical element comprises a distribution of color over an area of the display.

4. The method of claim 1, further comprising selectively rendering an appearance of the source graphical element on the display based on the state of the input.

5. The method of claim 1, further comprising selectively rendering an appearance of the sink graphical element on the display based on a state of the lighting element.

6. The method of claim 1, wherein the input includes data sensed by one or more sensors of a mobile computing device.

7. The method of claim 1, wherein the selective illumination includes selective illumination of the lighting element to emit light of a particular hue based on the state of the input.

8. The method of claim 1, wherein the input comprises an indication of whether a particular event has occurred.

9. The method of claim 1, wherein the selective illumination comprises selecting a property of light emitted by the lighting element based on a degree of proximity between the source graphical element and the sink graphical element.

10. A linking computing device, comprising:

one or more processors;

a display operably coupled with the one or more processors; and memory storing instructions that, in response to execution of the instructions by the one or more processors, cause the one or more processors to:

render, on the display, a source graphical element that represents an input and a sink graphical element that represents a lighting element; and link selective illumination of the lighting element to a state of the input in response to a determination that the source and sink graphical elements are within a predetermined proximity of each other on the display, wherein the input comprises a user's mood or status obtained from a social network or calendar.

11. The linking computing device of claim 10, wherein the determination comprises a determination that one of the source and sink graphical elements at least partially overlaps the other.

12. The linking computing device of claim 10, wherein the source graphical element comprises a distribution of color over an area of the display.

13. The linking computing device of claim 10, wherein the instructions, in response to execution by the one or more processors, further cause the one or more processors to selectively render an appearance of the source graphical element on the display based on the state of the input.

14. The linking computing device of claim 10, wherein the instructions, in response to execution by the one or more processors, further cause the one or more processors to selectively render an appearance of the sink graphical element on the display based on a state of the lighting element.

15. The linking computing device of claim 10, wherein the input includes data sensed by one or more sensors of a mobile computing device.

16. The linking computing device of claim 10, wherein the selective illumination includes selective illumination of the lighting element to emit light of a particular hue based on the state of the input.

17. The linking computing device of claim 10, wherein the input comprises an indication of whether a particular event has occurred.

18. The linking computing device of claim 10, wherein the lighting element comprises a first lighting element, the sink graphical element represents a plurality of lighting elements that includes the first lighting element, and the link comprises link selective illumination of the plurality of lighting elements to the state of the input.

19. A method of linking selective illumination of a lighting element to input, comprising:

rendering, by a computing device on a display of the computing device, a source graphical element that represents the input, and a sink graphical element that represents the lighting element;

receiving, at a user input of the computing device, an instruction to alter one of the source and sink graphical elements to be within a predetermined proximity of the other of the source and sink graphical elements on the display; and linking, by the computing device, selective illumination of the lighting element to a state of the input while the source and sink graphical elements are within the predetermined proximity of each other on the display, wherein the linking comprises linking, by the computing device, selective illumination of the lighting element to a sequence of states of the input, or to a time-shifted state of the input.

20. A linking computing device, comprising:

one or more processors;

a display operably coupled with the one or more processors; and memory storing instructions that, in response to execution of the instructions by the one or more processors, cause the one or more processors to:

render, on the display, a source graphical element that represents an input and a sink graphical element that represents a lighting element; and link selective illumination of the lighting element to a state of the input in response to a determination that the source and sink graphical elements are within a predetermined proximity of each other on the display, wherein the linking comprises linking selective illumination of the lighting element to a sequence of states of the input, or to a time-shifted state of the input.

* * * * *